US009758932B2

(12) United States Patent
Lu et al.

(10) Patent No.: US 9,758,932 B2
(45) Date of Patent: Sep. 12, 2017

(54) BALLASTLESS TRACK SYSTEM

(75) Inventors: Chunfang Lu, Haidian District Bejing (CN); Youming Zhao, Haidian District Bejing (CN); Cheng Jiang, Haidian District Bejing (CN); Jijun Wang, Haidian District Bejing (CN); Meng Wang, Haidian District Bejing (CN); Yong Zhao, Haidian District Bejing (CN); Weibin Liu, Haidian District Bejing (CN); Ziqing Jiang, Haidian District Bejing (CN); Ruilin You, Haidian District Bejing (CN); Xianggang Du, Haidian District Bejing (CN); Jia Fan, Haidian District Bejing (CN)

(73) Assignee: RAILWAY ENGINEERING RESEARCH INSTITUTE OF CHINA ACADEMY OF RAILWAY SCIENCES, Beijing (CN)

( * ) Notice: Subject to any disclaimer, the term of this patent is extended or adjusted under 35 U.S.C. 154(b) by 295 days.

(21) Appl. No.: 14/342,242

(22) PCT Filed: Aug. 28, 2012

(86) PCT No.: PCT/CN2012/080667
§ 371 (c)(1),
(2), (4) Date: Feb. 28, 2014

(87) PCT Pub. No.: WO2013/029530
PCT Pub. Date: Mar. 7, 2013

(65) Prior Publication Data

US 2014/0203094 A1 Jul. 24, 2014

(30) Foreign Application Priority Data

Aug. 31, 2011 (CN) ..... 2011 1 0256448

(51) Int. Cl.
*E01B 1/00* (2006.01)
*E01B 3/40* (2006.01)

(52) U.S. Cl.
CPC ..... *E01B 1/007* (2013.01); *E01B 1/002* (2013.01); *E01B 1/004* (2013.01); *E01B 3/40* (2013.01)

(58) Field of Classification Search
CPC . E01B 1/00; E01B 1/002; E01B 1/004; E01B 1/007; E01B 3/40
See application file for complete search history.

(56) References Cited

U.S. PATENT DOCUMENTS 3,382,815 A * 5/1968 Yoshiro ..... E01B 1/002 104/3
4,905,896 A * 3/1990 Eisenmann ..... E01B 1/004 238/2

(Continued)

FOREIGN PATENT DOCUMENTS

CN 201095715 Y 8/2008
CN 101424061 A 5/2009

(Continued)

OTHER PUBLICATIONS

Zhang, Zhenzhen et al., "Discussion on reinforcement design of convex shape platform of double-block ballastless track on bridge," Subgrade Engineering, No. 6, 2009, pp. 162-163. (English Language Abstract).

(Continued)

*Primary Examiner* — Zachary Kuhfuss
(74) *Attorney, Agent, or Firm* — Shumaker & Sieffert, P.A.

(57) ABSTRACT

A ballastless track system comprises a base; a track slab arranged above the base; a poured-field layer arranged between the base and the track slab, the poured-field layer being formed by filling self-compacting concrete, emulsified (Continued)

asphalt cement mortar or resin mortar, and the inside of the poured-field layer being of a steel bar structure; a connecting piece, the first end of the connecting piece extending into the track slab, and the second end of the connecting piece extending into the poured-field layer; and two rows of rail-seat arranged on the track slab in parallel; and rails arranged on the rail-seat. The ballastless track system is high in reliability, good in durability, and easy in construction and maintenance.

13 Claims, 3 Drawing Sheets

(56) References Cited

U.S. PATENT DOCUMENTS

| | | | | |
|---|---|---|---|---|
| 2008/0230621 | A1* | 9/2008 | Bogl | E01B 1/002 238/25 |
| 2013/0264394 | A1* | 10/2013 | Wang | E01B 1/002 238/7 |

FOREIGN PATENT DOCUMENTS

| | | | |
|---|---|---|---|
| CN | 101798785 | A | 8/2010 |
| CN | 101798786 | A | 8/2010 |
| CN | 201648878 | U | 11/2010 |
| CN | 201908236 | U | 7/2011 |
| EP | 0663470 | A1 | 7/1995 |

OTHER PUBLICATIONS

International Search Reported for corresponding PCT Application No. PCT/CN2012/080667, dated Oct. 4, 2012 (7 pgs.).

* cited by examiner

BALLASTLESS TRACK SYSTEM

CROSS REFERENCE TO RELATED APPLICATIONS

This application is a national stage entry under 35 U.S.C. §371 of PCT Application No. PCT/CN2012/080667, filed Aug. 28, 2012, which claims the benefit of Chinese Application No. 201110256448.6, filed Aug. 31, 2011. The entire contents of PCT Application No. PCT/CN2012/080667 and Chinese Application No. 201110256448.6 are incorporated herein by reference.

TECHNICAL FIELD

The present invention relates to a track system, and more particularly to a ballastless track system.

BACKGROUND

Ballastless track structures, which are featured with high regularity, high stability, high durability and high reliability, are accepted by high-speed railways in countries all over the world and also broadly applied to high-speed railways in China. At present, there are numerous types of ballastless track structures at home and abroad, generally including two structural systems, a unit one and a longitudinally continuous one.

Comparing and analyzing technical characteristics of different types of ballastless tracks, a unit ballastless track mainly includes structural layers including a track slab, a poured-field layer, and a base etc. The track slab applies a prefabricated slab. The poured-field layer and the base are arranged laid below the track slab in turn, wherein as a key structural layer for elasticity adjustment and force transmission support of the ballastless track structure, the poured-field layer directly affects rapid and safe operation of a high-speed train. In an existing ballastless track structure, a track slab is longitudinally laid on a poured-field layer along a line and a circular convex barricade is applied between two adjacent track slabs along the longitudinal direction during a laying process. After the track slab is adjusted and installed in place, an asphalt mortar poured-field layer is filled between the track slab and the poured-field layer, and resin mortar is filled in a gap between the track slab and the circular convex barricade. The track slab is provided as a unit having a structure with explicit force bearing and transmission as well as good maintainability. However, a disadvantage is the tedious construction of the convex barricade. In addition, after the line is put into operation for a period of time, the track slab may be split from the asphalt mortar poured-field layer and a longitudinal end of the track slab may warp easily, which undoubtedly causes adverse impact on train stability and riding quality, and track system durability.

A longitudinally connected ballastless track slab applies prefabricated polished slabs with pre-split cracks. The slabs are longitudinally connected, and the track is laid with relatively high precision. However, the longitudinally connected ballastless track slab, which is complicated in connection structure, has bad environmental adaptability and maintainability. A double-block ballastless track structure with relatively simple components and poured-in-place roadbed slabs is highly adaptable to different types of fasteners and relatively low in construction cost, but with a large amount of concrete construction and hardly-controlled roadbed slab cracks.

Valuable experiences in aspects including structural design, construction methods, technical requirements of track foundations etc. of ballastless tracks has been accumulated during the pass more than 50 years of researches and practice in China, which lays a foundation for further development of ballastless track technologies.

SUMMARY

The present invention aims to provide a ballastless track system which is high in reliability, good in durability, and easy in construction and maintenance.

To realize the purpose above, the present invention provides a ballastless track system, including: a base; a track slab arranged above the base; a poured-field layer arranged between the base and the track slab, the poured-field layer being formed by filling self-compacting concrete, emulsified asphalt cement mortar or resin mortar, and the inside of the poured-field layer being provided with a first steel bar structure; two rows of rail-seat arranged on the track slab in parallel; and rails arranged on the rail-seat.

Further, the ballastless track system is a unit structure.

Further, the first steel bar structure is arranged into a single-layer net-shape, and the first steel bar structure is located on a position in the middle or under the middle of the poured-field layer along the height direction.

Further, the first steel bar structure is arranged into a multilayer net-shape or a steel reinforcement cage, and the first steel bar structure is arranged symmetrically along a central plane of the poured-field layer along the height direction.

Further, it further comprises a connecting piece, the first end of the connecting piece extending into the track slab, and the second end of the connecting piece extending into the poured-field layer; the connecting piece being integrated with the track slab and the connecting piece being made of an insulating material.

Further, the projections of the connecting piece and the projections of the rails are at least partly overlapped in the top view plane of the rails, and the projections of the connecting piece in the top view plane of the rails is located within the projections of the rail-seat in the top view plane of the rails.

Further, the base is made of concrete, and a second steel bar structure is provided in the base.

Further, the base is provided with a position-limiting structure acting on the poured-field layer; the position-limiting structure is a position-limiting lug boss; the base is provided with a position-limiting groove in the extension direction; the position-limiting lug boss is formed by protruding the poured-field layer into the position-limiting groove.

Further, the cross section of the position-limiting lug boss is circular, and a cushion layer is provided on an annular surface of the position-limiting groove of the base.

Further, the cross section of the position-limiting lug boss is rectangular, and cushion layers are provided on two opposite planes in the longitudinal direction, or on two opposite locations in the transverse direction or on four peripheral side faces of the position-limiting groove of the base.

Further, the included angle between the cushion layer and the horizontal direction is larger than or equal to 45 degree, and smaller than or equal to 90 degree.

Further, the thickness of the cushion layer is larger than or equal to 5 mm, and smaller than or equal to 50 mm.

Further, the cushion layer is a double-layer structure; the outer layer of the cushion layer is made of a hard foamed plastic plate or a foam plate and the inner layer of the cushion layer is made of rubber, foaming material, vulcanized rubber or resin.

Further, the track slab and the two rows of rail-seat are integrated, wherein the distances between the rail-seat in one row of rail-seat are longer than those between the rail-seat in the other row of rail-seat.

Further, the track slab and the two rows of rail-seat are integrated, wherein the rail-seat of one row are higher than the rail-seat of the other row in a direction vertical to the track slab.

Further, the track slab the two rows of rail-seat are integrated, wherein the gauge between one row of rail-seat and the other row of rail-seat is variable.

Applying the technical solution of the present invention, a ballastless track system includes: a base, a track slab, a poured-field layer, a connecting piece, two rows of rail-seat and rails. In the structure above, the track slab is arranged on the base, the poured-field layer is arranged between the base and the track slab, the poured-field layer is formed by filling self-compacting concrete, emulsified asphalt cement mortar or resin mortar, and the inside of the poured-field layer is provided with a first steel bar structure, and two rows of rails are arranged on the rail-seat.

The track slab and the poured-field layer are connected integrally to form a firm composite structure, thus improving the integrity of the track system, and meeting requirements of the track on stability and comfort. The poured-field layer is formed by filling the self-compacting concrete, the emulsified asphalt cement mortar or the resin mortar so that the poured-field layer has mechanical properties which are as close to those of the track slab as possible with little difference in strength, and the track slab can be adjusted, thus effectively overcoming easily splitting between a track slab and a poured-field layer formed by asphalt mortar, and easily-caused warping of a longitudinal end of the track slab in the prior art. At the same time, the poured-field layer is formed by filling the self-compacting concrete, the emulsified asphalt cement mortar or the resin mortar, thus simplifying processes, facilitating control of construction quality and reducing pollution to the environment. The first steel bar structure in the poured-field layer can improve mechanical characteristics of the poured-field layer. It can be concluded by the description above that the ballastless track system of the present invention is high in reliability, good in durability, and easy in construction and maintenance.

BRIEF DESCRIPTION OF THE DRAWINGS

The accompanying drawings in the specification, which constitute a part of the application, are used for providing further understanding to the present invention. The exemplary embodiments of the present invention and the illustrations thereof are used for explaining the present invention, instead of constituting an improper limitation to the present invention. In the accompanying drawings.

DETAILED DESCRIPTION

It should be noted that, if there is no conflict, the embodiments of the application and the characteristics in the embodiments can be combined with one another. The present invention will be described in details below with reference to the accompanying drawings and in combination with the embodiments.

Figure 1:
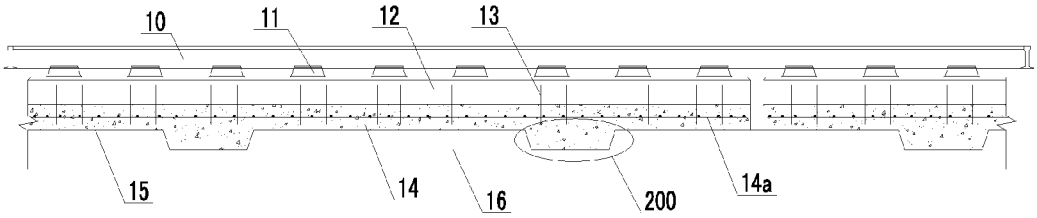
FIG. 1 shows a structural diagram of a longitudinal section of a ballastless track system according to the first embodiment of the present invention.
Figure 2:
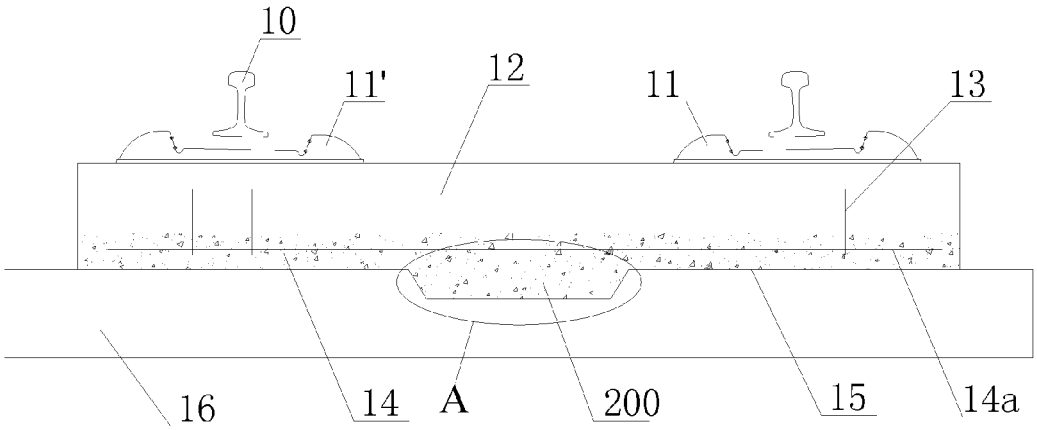
FIG. 2 shows a schematic diagram of a transverse section of the ballastless track system of FIG. 1.

FIG. 1 shows a structural diagram of a longitudinal section of a ballastless track system according to the first embodiment of the present invention. FIG. 2 shows a schematic diagram of a cross section of the ballastless track system of FIG. 1. Referring to FIG. 1 and FIG. 2, it can be seen in the figures that the ballastless track system of the present embodiment includes: a base 16, a track slab 12, a poured-field layer 14, a connecting piece 13, two rows of rail-seat 11 and 11' and rails 10. In the structure above, the track slab 12 is arranged on the base 16. The poured-field layer 13 is arranged between the base 16 and the track slab 12. The poured-field layer 14 is formed by filling self-compacting concrete, emulsified asphalt cement mortar or resin mortar, and the inside of the poured-field layer 14 is provided with a first steel bar structure 14*a*. Two rows of rail-seat 11 and 11' are arranged on the track slab 12 in parallel and the rails 10 are arranged on the rail-seat 11 and 11'.

The track slab 12 is connected integrally with the poured-field layer 14 through connecting piece 13 and the bonding force between the track slab 12 and the poured-field layer 14 to form a firm composite structure, thus improving the integrity of the track system, and meeting requirements of the track on stability and comfort. The poured-field layer is formed by filling the self-compacting concrete, the emulsified asphalt cement mortar or the resin mortar so that the poured-field layer has mechanical properties which are as close to those of the track slab as possible with little difference in strength, and the track slab can be adjusted, thus effectively overcoming easy splitting between a track slab and a poured-field layer formed by asphalt mortar, and easily-caused warping of a longitudinal end of the track slab 12 in the prior art. At the same time, the poured-field layer 14 is formed by filling the self-compacting concrete, the emulsified asphalt cement mortar or the resin mortar, thus simplifying processes, facilitating control of engineering quality and reducing pollution to the environment. The first steel bar structure 14*a* in the poured-field layer 14 can improve mechanical characteristics of the poured-field layer. It can be concluded by the description above that the ballastless track system of the present invention is high in reliability, good in durability, and easy in construction and maintenance.

Preferably, the ballastless track system is a unit structure, different lines, such as a subgrade, a bridge, a tunnel and the like, have unit structures. For example, in the case of a subgrade, one base 16 and three track slabs 12 are provided.

In the case of a bridge, one base 16 and one track slab 12 are provided. In the case of a tunnel, one base 16 and three track slabs 12 are provided. The advantage is that base segments in a subgrade section are relatively short to adapt to relatively large temperature gradients and temperature differences in severe cold areas and cold areas, and that a base is arranged within the length of a single slab in a bridge section to improve the constructability and maintainability of a track system.

The first steel bar structure 14*a* in the poured-field layer 14 is arranged into a single-layer net-shape, a multilayer net-shape or a steel reinforcement cage. Preferably, as shown in FIG. 1, the first steel bar structure 14*a* is arranged into a single-layer net-shape to facilitate mechanized construction. The first steel bar structure 14*a* is located on a position in the middle or under the middle of the poured-field layer 14 along the height. Or preferably, if the poured-field layer 14 is relatively thick, the first steel bar structure 14*a* is arranged into a multilayer net-shape or a steel reinforcement cage. The first steel bar structure 14*a* is arranged symmetrically along a central plane of the poured-field layer 14 along the height. At the same time, when the first steel bar structure 14*a* is arranged into a multilayer net-shape or a steel reinforcement cage, it should be noted that the multilayer net-shape or the steel reinforcement cage should be arranged away from other components to avoid mutual interference. Besides construction adjustment and filling, the poured-field layer 14 with the steel bar structure further plays a force bearing function to bear longitudinal and transverse forces generated by train load and temperature load etc. and overcome adverse effect caused by foundation subsidence etc. on structures of upper track structure.

In the present embodiment, the first end of the connecting piece 13 of the ballastless track system extends into the track slab 12 and the second end of the connecting piece 13 extends into the poured-field layer 14. Because of material bond behaviors, a bonding plane may be formed between the poured-field layer 14 and the track slab 12. Bonding between the two layers, i.e. the track slab 12 and the poured-field layer 14 may be affected by vibration and impact generated by actions of a train on the structures of the upper portions, load caused by temperature changes and shrinkage of materials etc., thus the connecting piece 13 needs to be arranged if necessary to enhances the bonding between the two layers so as to form the track slab 12 and the poured-field layer 14 into a firm "composite structure" which kept reliable for a long time. The connecting piece 13 may be applied as a form of an embedded extended steel bar on the bottom of the track slab 12. The forms of the extended steel bar may be different structural patterns of steel bar components etc. including shear studs, a single extended steel bar, or a door-shaped extended steel bar and the like. Preferably, to meet requirements of track circuit insulation and general earthing, the connecting piece 13 is made of an insulating material. The connecting piece 13 is preferably resin steel bar or a steel bar with an insulating coating. The connecting piece 13 connects, through methods of arranging an anchor bar or an anchor pin etc. by means of pre-embedding, or drilling a hole in a later period or reserving a hole etc., a portion which needs to be reinforced, thus the composite structure is more secure and reliable while reducing the height of the track system.

Preferably, the projections of the connecting piece 13 and the projections of the rails 10 are at least partly overlapped in the top view plane of the rails 10, and the projections of the connecting piece 13 in the top view plane of the rails 10 is located within the projections of the rail-seat 11 and 11' in the top view plane of the rails 10. The connecting piece 13 is located on such a position so as to bear longitudinal and lateral forces generated by train load and temperature load etc. and overcome adverse effect caused by foundation subsidence etc. on structures of upper track portions while locally reinforcing the track slab and the poured-field layer.

To support the composite structure formed by the track slab 12, the connecting piece 13 and the poured-field layer 14, the base 16 is preferably made of concrete, and a second steel bar structure is provided in the base 16. Generally, regular steel bars may be applied for reinforcement in the base 16. An isolation layer 15 is paved on an upper surface (between the base 16 and the poured-field layer 14) of the base 16 to isolate the composite structure and the base 16. At the same time, the isolation layer 15 can regulate distortion among different structural layers to buffer vibration caused by the train to a certain extent while preventing cracks generated by long term service of the base 16 from developing on the structures of the upper portions and providing conditions for maintenance and repair of the damaged track system. The isolation layer 15 is preferably a geotextile with a certain friction coefficient and good hydrophobicity performance, such as earthwork cloth etc.

Figure 3:
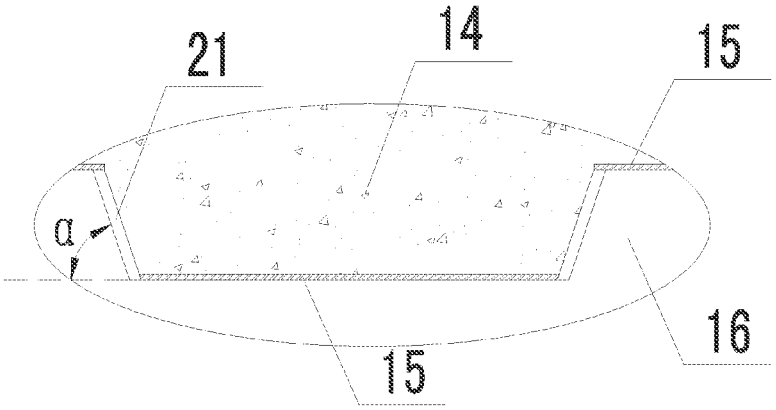
FIG. 3 shows a drawing of partial enlargement of Part A in FIG. 2.

Preferably, in order to increase the safety and stability of the track slab 12 of the ballastless track system to avoid longitudinal and transverse displacement under the action of an external force, a position-limiting structure 200 is arranged on the base 16 to limit the position thereof in the longitudinal and transverse directions. Specifically, the base 16 is provided with the position-limiting structure 200 acting on the poured-field layer 14. As shown in FIG. 2 and FIG. 3, in the present embodiment, the position-limiting structure 200 is a position-limiting lug boss. The base 16 is provided with a position-limiting groove in the extension direction. The position-limiting lug boss is formed by protruding the poured-field layer 14 into the position-limiting groove.

The cross section of the position-limiting lug boss (along the extension direction of the track slab 12) may be multiple structures, wherein preferably, the cross section of the position-limiting lug boss is circular. An annular surface of the position-limiting groove of the base 16 is provided with a cushion layer 21. The isolation layer 15 is provided between the poured-field layer 14 and the base 16 except the position of the cushion layer 21. The isolation layer 15 and the elastic cushion layer 21 can be provided to prevent a dangerous force from acting on the position-limiting lug boss and the position-limiting groove without substantially weakening the action of the position-limiting structure 200.

Or, in another embodiment, the cross section of the position-limiting lug boss is rectangular. Cushion layers 21 are arranged on two opposite planes in the longitudinal direction, or on two opposite locations in the transverse direction or on four peripheral side surfaces of the position-limiting groove of the base 16. Similarly, the isolation layer 15 is provided between the poured-field layer 14 and the base 16 besides the position of the cushion layer 21. The isolation layer 15 has the same function as that in the embodiment above, which will not be repeated here.

It should be noted that the cushion layer 21 should be provided close to a side of the position-limiting groove. The slope should not be too gentle. Otherwise, longitudinal and transverse position limitation of the composite structure of the track slab 12 and the poured-field layer 14, i.e. the stability of the track system, may be adversely affected. Preferably, the included angle $\alpha$ between the cushion layer 21 and the horizontal direction is larger than or equal to 45 degree, and smaller than or equal to 90 degree. Preferably, an appropriate thickness of the cushion layer 21 is larger than or equal to 5 mm, and smaller than or equal to 50 mm.

Preferably, the cushion layer 21 is a double-layer structure. The outer layer of the cushion layer 21 is made of a foamed plastic plate or a foam plate with relatively low rigidity and the inner layer of the cushion layer 21 is made of rubber, foaming material, vulcanized rubber or resin. The cushion layer should have good hydrophobicity performance.

Figure 5:
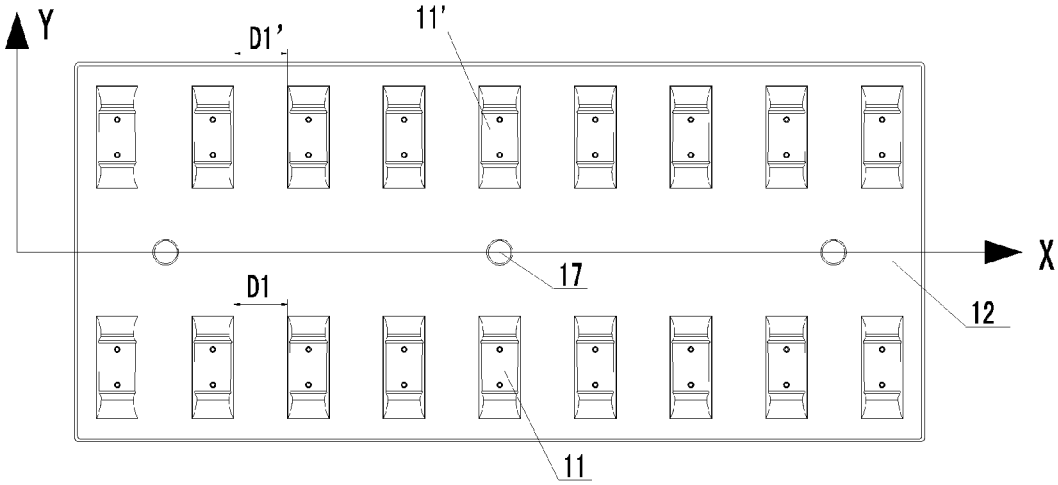
FIG. 5 shows a schematic diagram of a track slab of the ballastless track system in FIG. 1.

The ballastless track system of the present invention is similarly well-adaptive to both curve sections and vertical curve sections. As shown in FIG. 5, regular steel bars are provided in the track slab 12. The steel bars may apply measures including resin steel bars, insulating coatings and insulting cards etc. to satisfy technical requirements of track circuit insulation. As an alternative and a particularly advantageous form, a pre-stressed structure combining common steel bars and pre-stressed steel bars is applied to effectively preventing cracks on the track slab 12. Several perfusion holes 17 are provided on the track slab 12 to facilitate pouring of the poured-field layer 14. The two rows of rail-seat 11 and 11' on the track slab 12 may be adjusted during a manufacturing process of the track slab 12 along an X axis, a Y axis and the vertical direction of the track slab 12 as shown in the figure, which is very favorable for the track system to adapt to sections with different line directions.

In a preferred embodiment, as shown in FIG. 5, the track slab 12 and the two rows of rail-seat 11 and 11' are integrated, wherein the distance D1' between the rail-seat 11' in one row of rail-seat 11' are longer than those D1 between the rail-seat 11 in the other row of rail-seat 11. For a curve section, the two rows of rail-seat 11 and 11' may be arranged symmetrically along a curve. At the moment, the distances D1' between the rail-seat 11' in one row of rail-seat 11' are longer than those D1 between the rail-seat 11 in the other row of rail-seat 11. Thus the number of the rail-seat 11' is reduced without affecting track running stability and further save cost.

Figure 4:
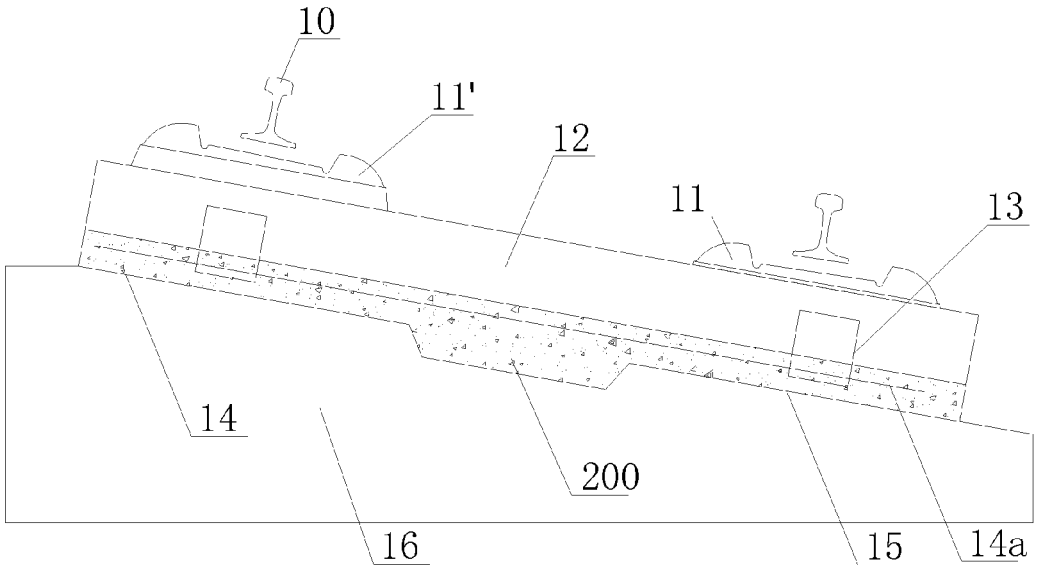
FIG. 4 shows a structural diagram of a cross section of a ballastless track system according to the second embodiment of the present invention.

In the second embodiment, as shown in FIG. 4, the track slab 12 and the two rows of rail-seat 11 and 11' are integrated, wherein the rail-seat 11' of one row are higher than the rail-seat 11 of the other row in a direction perpendicular to the track slab 12. Superelevation of a curve section may be implemented by the line base 16. At the same time, when the track slab 12 is manufactured, the heights of the two rows of rail-seat 11 and 11' arranged on the top surface of the track slab 12 may be adjusted according to setting requirements of the superelevation of the curve, thus satisfying requirements on changes of the superelevation and adjustment of track alignment of the curve section while reducing the workload of later fine adjustment of the track.

Figure 6:
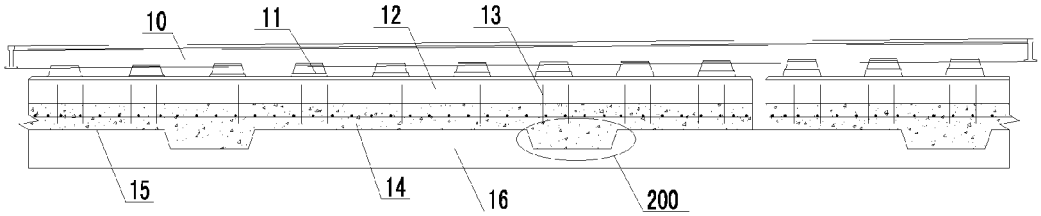
FIG. 6 shows a schematic diagram of a longitudinal section of a ballastless track system according to the third embodiment of the present invention.

As shown in FIG. 6, in the third embodiment, the heights of the two rows of rail-seat increased gradually to adapt to curve sections. FIG. 6 only shows a gradual increase trend of a rail-seat 11.

In another preferred embodiment, the track slab 12 and the two rows of rail-seat 11 and 11' are integrated, wherein the gauge between one row of rail-seat 11' and the other row of rail-seat 11 is variable to adapt to application of a section with gauge widening, an expansion joint, or a section with turnouts.

It can be seen from the description above that, the embodiments of the utility model realize the following technical effect:

1. the track slab is prefabricated in a factory, which is easy to guarantee the manufacturing quality and precision, reduces the amount of onsite concrete construction, and accelerates construction progress; a pre-stressed design may be applied and the track slab will not crack under a normal service load, which improves the durability of the track structure; the spatial positions of the rail-seat are adjustable, which is favorable for fine adjustment of track directions;
2. different types of fastener systems may be applied in a matched manner to provide better elasticity for the track system while reducing the workload of fine adjustment of the rails;
3. the poured-field layer, e.g. self-compacting concrete is poured under the track slab to form the composite structure through the connecting piece or interlayer bonding, thus improving the stressed state of the track slab; a emulsified asphalt cement mortar filling layer may be replaced by self-compacting concrete and the track system is made of a single engineering material, which can reduce engineering cost and improve the durability of the track system;
4. the position of the track slab is limited through interlayer bonding or the connecting piece, the position of the "composite structure" formed by the track slab and the poured-field layer is limited mechanically through the position-limiting structure of the base and a convex barricade is removed, which improves the constructability of the track system and realizing good track structural stability;
5. the isolation layer is arranged between the poured-field layer and the base to regulate distortion between the "composite structure" and the base and prevent the cracks on the base from developing on the poured-field layer while providing conditions for restoration of the track system in special conditions.

The above are only preferred embodiments of the present invention and are not used for limiting the present invention. For those skilled in the art, the present invention may have various modifications and changes. Any modifications, equivalent replacements, improvements and the like within the spirit and principle of the present invention shall fall within the scope of protection of the present invention.

Figure 7:
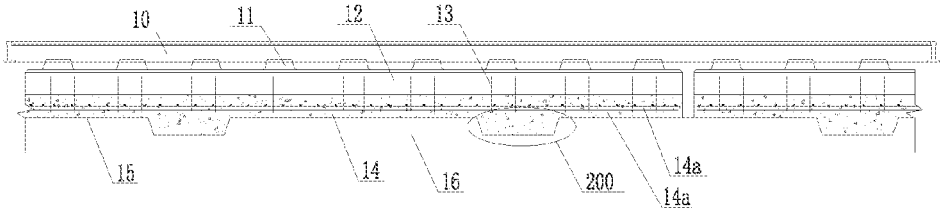
FIG. 7 shows a structural diagram of a longitudinal section of a ballastless track system according to an alternative embodiment of the present invention.

In the FIG. 7, a reference number 10 shows the feature "rails", a reference number 11 shows the feature "rail-seat", a reference number 12 shows the feature "track slab", a reference number 13 shows the feature "connecting piece", a reference number 14 shows the feature "poured-field layer", a reference number 15 shows the feature "isolation layer", a reference number 16 shows the feature "base".

The invention claimed is:

1. A ballastless track system comprising:

a base;

a track slab arranged above the base;

a poured-field layer arranged between the base and the track slab, the poured-field layer being formed by filling self-compacting concrete, emulsified asphalt cement mortar or resin mortar, and an inside of the poured-field layer being provided with a first steel bar structure;

two rows of rail-seat arranged on the track slab in parallel; and rails arranged on the rail-seat, wherein the base is provided with a position-limiting structure acting on the poured-field layer, wherein the position-limiting structure is a position-limiting lug boss, wherein the base comprises a position-limiting groove in the extension direction, wherein the position-limiting lug boss is formed by protruding the poured-field layer into the position-limiting groove, wherein a cross section of the position-limiting lug boss is rectangular, wherein cushion layers are provided only on two opposite planes in the longitudinal direction or on two opposite locations in a transverse direction or on four peripheral side faces of the position-limiting groove of the base, wherein the cushion layer is provided close to a side of the position-limiting groove, wherein the cushion layer is a double-layer structure, wherein the double-layer structure comprises a foam plate outer layer and a rubber inner layer located in vertically adjacent contact, and wherein a thickness of the cushion layer is greater than or equal to 5 mm, and smaller than or equal to 50 mm.

2. The ballastless track system according to claim 1, wherein the ballastless track system is a unit structure.

3. The ballastless track system according to claim 1, wherein the first steel bar structure is arranged into a single-layer net-shape, and the first steel bar structure is located on a position in a middle or under the middle of the poured-field layer along a height direction.

4. The ballastless track system according to claim 1, wherein the first steel bar structure is arranged into a multilayer net-shape, and the first steel bar structure is arranged symmetrically along a central plane of the poured-field layer along a height direction.

5. The ballastless track system according to claim 1, wherein the ballastless track system further comprises a connecting piece, the first end of the connecting piece extending into the track slab, and the second end of the connecting piece extending into the poured-field layer; the connecting piece being integrated with the track slab and the connecting piece being made of an insulating material.

6. The ballastless track system according to claim 1, wherein projections of the connecting piece and projections of the rails are at least partly overlapped in the top view plane of the rails, and the projections of the connecting piece in the top view plane of the rails is located within projections of the rail-seat in the top view plane of the rails.

7. The ballastless track system according to claim 1, wherein the base is made of concrete, and a second steel bar structure is provided in the base.

8. The ballastless track system according to claim 1, wherein an included angle ($\alpha$) between the cushion layer and a horizontal direction is larger than or equal to 45 degrees, and smaller than or equal to 90 degrees.

9. The ballastless track system according to claim 1, wherein track slab and the two rows of rail-seat are integrated, wherein distances (D1') between the rail-seat in one row of rail-seat are longer than those (D1) between the rail-seat in the other row of rail-seat.

10. The ballastless track system according to claim 1, wherein the track slab and the two rows of rail-seat are integrated, wherein the rail-seat of one row are higher than the rail-seat of the other row in a direction vertical to the track slab.

11. The ballastless track system according to claim 1, wherein the track slab and the two rows of rail-seat are integrated, wherein a gauge between one row of rail-seat and the other row of rail-seat is variable.

12. The ballastless track system according to claim 1, wherein an included angle ($\alpha$) between the cushion layer and a horizontal direction is larger than or equal to 45 degrees, and smaller than or equal to 90 degrees.

13. The ballastless track system according to claim 1, wherein the thickness of the cushion layer is larger than or equal to 5 mm, and smaller than or equal to 50 mm.

* * * * *